US005893317A

United States Patent [19]

Kroger

[11] Patent Number: 5,893,317

[45] Date of Patent: Apr. 13, 1999

[54] PNEUMATIC BEATER

[75] Inventor: Dietrich Kroger, Wiesbaden, Germany

[73] Assignee: Netter GmbH, Mainz-Kastel, Germany

[21] Appl. No.: 08/993,590

[22] Filed: Dec. 18, 1997

[30] Foreign Application Priority Data

Dec. 18, 1996 [DE] Germany ..... 196 52 707

[51] Int. Cl.[6] ..... F15B 13/042

[52] U.S. Cl. ..... 91/440; 91/268; 91/272

[58] Field of Search ..... 91/218, 265, 268, 91/271, 272, 273, 318, 440

[56] References Cited

U.S. PATENT DOCUMENTS

| | | | |
|---|---|---|---|
| 3,853,037 | 12/1974 | Denzler et al. | 91/440 |
| 3,917,233 | 11/1975 | Blower . | |
| 4,996,907 | 3/1991 | Kroger . | |
| 5,070,769 | 12/1991 | Fehr . | |
| 5,183,121 | 2/1993 | Koudelka . | |

FOREIGN PATENT DOCUMENTS

| | | |
|---|---|---|
| 0 484 672 | 11/1990 | European Pat. Off. . |
| 24 39 586 | 8/1974 | Germany . |
| 25 49 551 | 5/1977 | Germany . |
| 38 19 111 | 6/1988 | Germany . |
| PCT/CH88/00143 | 8/1988 | WIPO . |

*Primary Examiner*—F. Daniel Lopez
*Attorney, Agent, or Firm*—Paul & Paul

[57] ABSTRACT

Pneumatic beater, the beating piston (18) of which is conducted in a movable fashion inside a housing (2) and can be pre-stressed on one side of the piston (18) by means of a pressurizing space (40) against the restoring force of a pressure spring (26) which is provided in a spring space (28) on the other side of the piston (18) inside the housing (2), and in which the connecting channel (42) for the compressed air from the pressurizing space (40) into the spring space (28), which channel can be freed by means of an automatic, quick-acting ventilation valve (48), is conducted directly through the piston (18). Inside the spring space, the channel (42) is extended by means of a pipe (34) which contains the valve arrangement (48). In a first form of implementation, the pipe (34) is solidly affixed to the housing and extends into a bore (30) in the piston, which is conducted over the pipe (34) in a sliding fashion. From the channel (42), the transfer air goes directly out through openings (46) in the wall of the pipe (34) which are freed by the valve arrangement (48) directly into the spring space (28). The direct flow path through the piston makes possible a largely loss-free transfer of air from one cylinder space into the other, which makes possible a more effective impact from the beater.

14 Claims, 2 Drawing Sheets

Figure 1A:
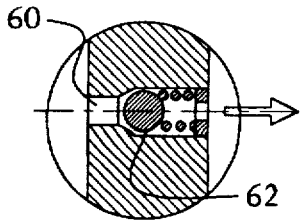

FIG. 3
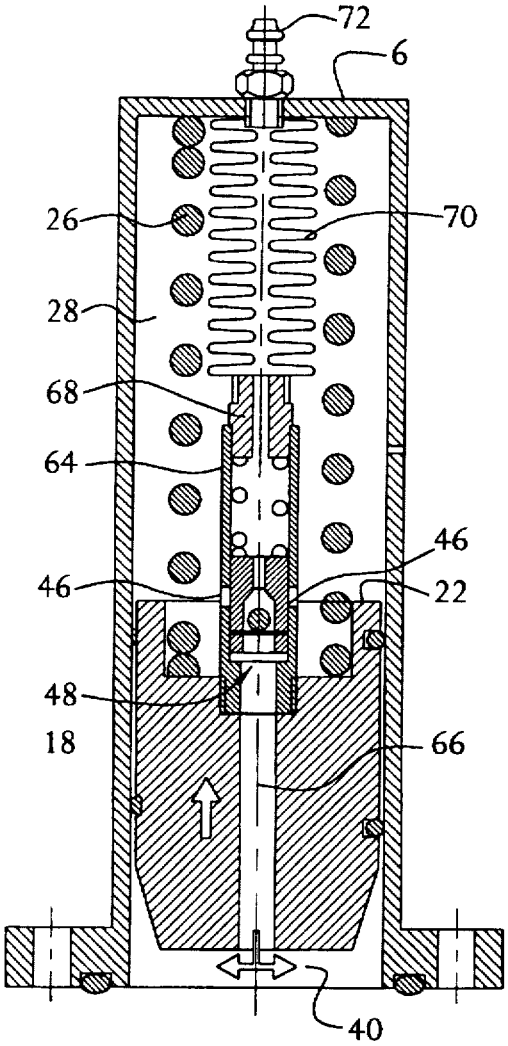
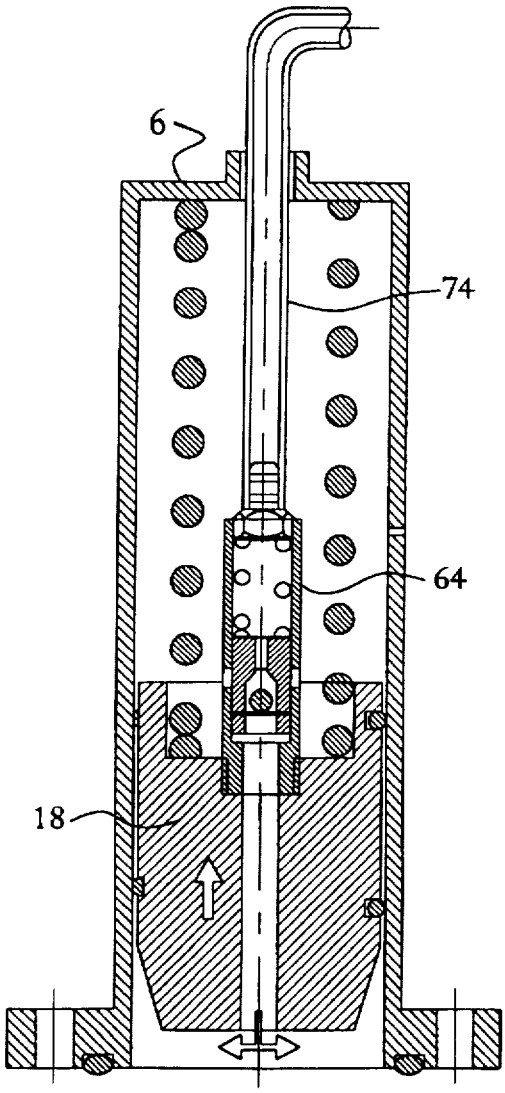
FIG. 4
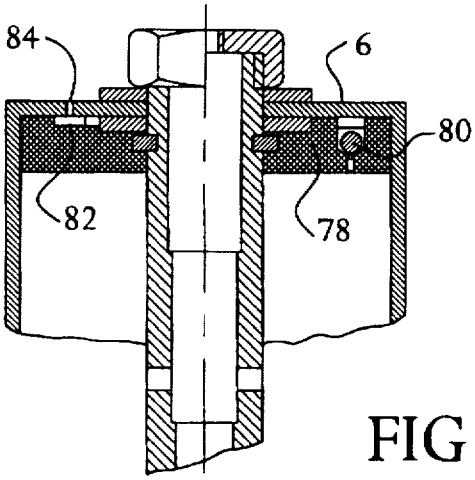
FIG. 5

PNEUMATIC BEATER

The invention pertains to a pneumatic beater, also known as a beater cylinder, in accordance with the characterizing clause of Patent claim 1.

In the context of this application, the terms "pneumatic" and "pressure medium" are meant to refer to the use of any gaseous or vaporous energy carrier.

Unlike pneumatic vibrators, in which a piston that can move back and forth inside a cylinder is alternately contacted on both sides by the pressure medium, in the case of a pneumatic beater of the type discussed here, only the cylinder space on one side of the piston is contacted by the pressure medium in order to move the piston against the restoring force of a spring that is resting against the other side of the piston. Upon the sudden release of pressure from the cylinder space, the piston is returned by the spring instantaneously.

A pneumatic beater of this type is described in DE-A-25 49 551, for example. In principle, it would be possible with beaters of this type to suddenly release the pressurization space into the outside. However, that procedure has a number of disadvantages. As a result of the rapid return movement of the piston during the impact, a negative pressure that would severely impair the stroking movement of the piston is created in the spring space of the cylinder. In principle, that disadvantage could be minimized by then joining the spring space to the outside by means of flow openings. However, this would mean that, with each stroke, outside air would be drawn into the spring space, which, depending on the outside conditions, would lead to contamination of the cylinder. In addition, constant flowing noises would become disturbingly apparent. As a result, it is generally the common practice with beaters of the type under consideration here to allow the pressurization space of the piston to be vented into the spring space by means of a quick-acting ventilation valve, so that in practice, a transfer of air from one cylinder space to the other takes place. The transfer process is accelerated due to the fact that a negative pressure occurs with the instantaneous return movement of the piston inside the spring space. With that form of implementation, in which the spring space is in essence enclosed, a ventilation opening of a certain size must, however, be provided in the wall of the spring space so that the air that is transferred into the spring space can escape when the piston is once again contacted by fresh compressed air. Since the time for the pre-stressing of the piston against the restoring force of the spring is not critical for a beater, the ventilation opening for the spring space can be relatively small. On the other hand, with a beater, it is important for the execution of impact that the venting of the pressurization space into the spring space takes place as rapidly as possible.

As a result, in the case of the object of DE-A 25 49 551, a hose with a relatively large cross-section is provided, which links the pressurization space outside of the cylinder with the spring space by means of a quick-acting ventilation valve. Since one or more hoses running on the outside of the cylinder is not practical due to certain reasons, in the case of the object of DE-A 38 19 111, the transfer lines were moved into the cylinder wall and a specially designed quick-acting ventilation valve was provided in the cylinder head on the spring space side. While this form of implementation did, in fact, represent an improvement in terms of functioning, it is more expensive and more complicated in terms of manufacturing engineering, since several transfer channels have to be bored into a cylinder wall of limited thickness, which then have to be brought together again in terms of their flow by means of the valve, which gives rise to substantial flow resistance.

A pneumatic linear vibrator is known from EP-A 330 687, in which the compressed air is fed in by means of a pipe which extends through the interior of a bored piston. However, this pipe is open only at the end which supplies air and is closed at the opposite end, and the air control is carried out by means of narrow grooves and channels in the wall of this pipe and in the interior wall of the piston's bore. With this previously known linear vibrator, an acceleration of the flow of working air is not achieved by means of the indicated design.

The invention performs the task of further improving the operation of a pneumatic beater of the type known from DE-A 38 19 111, as well as the task of further simplifying it in terms of manufacturing engineering, where the aim is to provide a smooth, easily cleaned surface, particularly for application in pharmaceutical operations, in the foodstuffs industry, etc.

In essence, this task is carried out by means of a connecting channel through the stroking piston and the spring space, with a secondary channel being formed by openings in the portion of the connecting channel through the spring space.

The shortest transfer path from the pressurization space into the spring space can be realized by running the connecting channel in a straight line directly from the pressurization space, through the piston, and into the spring space. In addition, the axial channel in the piston can easily be equipped with the necessary cross section. Also, the openings that form the secondary channel and which pass through the wall of the duct which connects to the piston pass-through can be designed for direct connection with the spring space and with a large enough cross section. These measures are relatively simple in terms of manufacturing engineering.

It is advantageous that the duct which connects to the channel in the piston is designed at least in part as a pipe or pipe segment. Since this pipe must also ensure a transition of the axial channel in the piston into the connecting duct even during the piston movement, in essence there are two options for securing this pipe. In a first form of implementation, the pipe extends all of the way through the spring space and is fastened at its one end to the end wall of the housing on the spring space side, where it advantageously joined to the supply connection for the pressure medium. In conjunction with that, the other end of the pipe projects into an axial bore in the piston, in which it is conducted in a sliding and sealed fashion. The piston thus moves not only along the interior wall of the cylinder jacket, but along the outer wall of the pipe as well.

In an alternative design, a pipe segment which projects into the spring space is fastened directly to the face of the piston on the spring space side. This pipe segment thus moves back and forth with the stroking piston. The connecting path for the compressed air which is to be fed in can also be carried out in a variety of ways. In a first form of implementation, the free end of the pipe segment is provided with a pressure-resistant metal expansion bellows, the other end of which is in turn joined with the housing end wall on the spring space side, and is there in communication with the supply connection for the pressure medium. This expansion bellows picks up the range of motion of the pipe segment which is carried along with the stroking piston. With a specific design, the metal expansion bellows can even exert a supporting spring action. Another option for the supplying of the compressed air consists in lengthening the pipe segment by means of an additional rigid or flexible pipe, for example, a pressure-resistant hose, and running it in a guide all the way through the end wall of the housing on the spring space side. In conjunction with that, the supply connection for the pressure medium is advantageously provided at the end of this pipe which is directed to the outside. The disadvantage of this form of implementation is that it is possible—if an additional protective cap is not provided—that a moving part can be located outside the beater housing, which, in the event of inappropriate contact, could lead to injuries. In principle, it is also possible to connect to the end of the pipe segment a flexible air supply hose which is directed through the housing wall of the spring space at any point and which exhibits sufficient free play within the spring space to be able to take up the piston movements.

In all forms of implementation, including the last-named, it is conceivable to locate the quick-acting ventilation valve in, for example, the housing end wall on the spring space side, and to provide the pass-through openings in the wall of the duct even outside of the cylinder housing, in order to direct the transfer-flow air through the housing end wall on the spring space side, for example, back into the spring space. Of course, an external placement of the quick-acting ventilation valve would also be possible if venting were to take place to the outside. However, that is not desirable for the reasons described above.

In the preferred form of implementation of the invention, however, the valve arrangement for quick venting is located within the pipe or pipe segment which forms a portion of the duct inside the spring space. This has the special advantage that the pass-through openings (which form the secondary channel) in the pipe which form the duct can be located in immediate proximity to the piston on the spring space side, which results in the shortest possible connecting path for the transfer process between the pressurization space and the spring space. Since the valve arrangement advantageously works in direct conjunction with the pass-through openings, it can also be provided inside the pipe in immediate proximity to the piston.

The valve arrangement located within the pipe which forms a portion of the duct advantageously exhibits a control part that can be moved in the axial direction within the pipe and which, in its resting position, is held against a limit stop by means of an elastic link, a pressure spring, for example, and which closes off the pass-through openings into the spring space when in this position. If an overpressure exists that is coming from the side of the stroking piston, the control part can be moved back against the restoring force of the elastic link in order to free the pass-through openings into the spring space. The control part is preferably a component of a control piston arrangement by means of which the described control functions can be carried out automatically.

In order to be able to supply the pressure medium for the operation of the beater through the connecting channel to the pressurization space, the control piston arrangement contains flow-through channels that contain a check valve which closes with the venting of the supply line and the resulting overpressure coming from the side of the stroking piston and with the freeing by the control part of the flow-through channels into the spring space as a result of the overpressure coming from the piston side, but which opens when overpressure comes from the supply connection for the pressure medium.

In many cases, the impact cycle of beaters of the type described here is controlled by means of a 3/2-way valve in the supply line for the pressure medium. With this form of implementation, the frequency is predetermined by the valve control. The arrangement of an external valve of such a type is shown schematically and described in DE-A 38 19 111, for example. However, pneumatic beaters can also be controlled automatically by internally installed means, as is described in DE-A 38 19 112. In that regard, the control of the supplying of the pressure medium is generally carried out by the piston itself, which frees or closes off specific control openings by means of its movements. The means for the automatic control, as they are described in DE-A 38 19 112, can also be transferred in an analogous way to the pneumatic beaters described here, since even narrower flow channels for the supplying of the pressure medium are acceptable here.

In order to prevent with certainty the entry of outside air into the spring space, the ventilation opening for the equalization of the overpressure in the spring space to the outside is also advantageously provided with a check valve which closes with higher outside pressure and thus prevents an inward flow of outside air into the spring space. This check valve can, for example, be designed as a ball check valve and can be placed on an extra plate, e.g., made of an elastomer, which is placed to the inside of the housing end wall on the spring space side. Use of this design prevents having to build the valve into the housing end wall in the manufacturing engineering stage. All that needs to be done to the end wall is to bore into it a small hole which is either directly flush with the ball check valve or else lies against a ring groove in the extra plate into which the ball check valve opens.

For the sealed guiding of the piston with respect to the housing jacket, and possibly with respect to the pipe projecting into the axial bore of the piston as well, PTFE sealing rings are advantageously provided for oil-free operation. Since the latter are difficult to install, particularly in inner grooves, it is advantageous to execute the stroking piston so that it is separated into radial planes at the location of such sealing ring grooves, whereby the piston parts can be screwed together following the arranging of the sealing rings.

As a rule, pneumatic beaters are constructed so that they are open on the side of the pressurization space, and are provided with a fastening flange into which a ring seal is inserted. The required opposing surface for the sealing of the pressurization space is then formed by a wall of the object to which the beater is firmly screwed. Between this object and the flange there can also be provided a spacer plate, the center region of which is formed by means of an elastomer insert. Such type of elastomer insert can also be placed into the piston-side end of the beater without a spacer plate, or it can even be sunk into the face of the piston itself.

The elastomer insert forms an additional contact surface for the piston.

Figure 1:
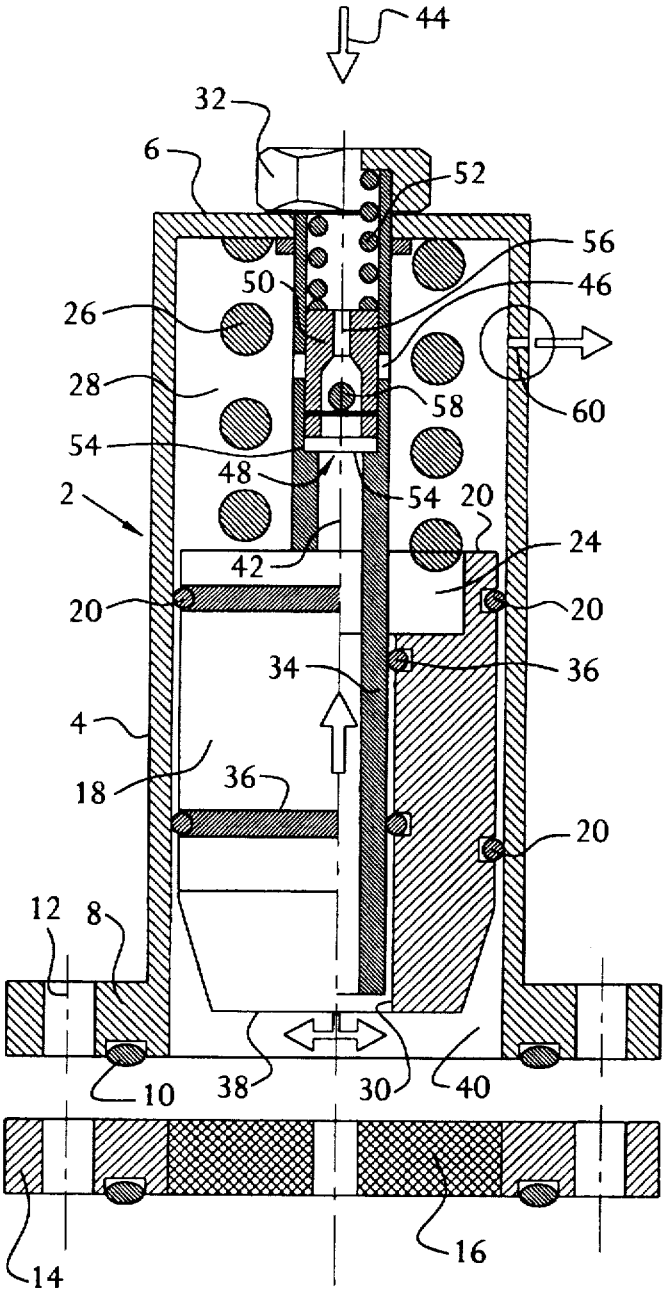
Figure 2:
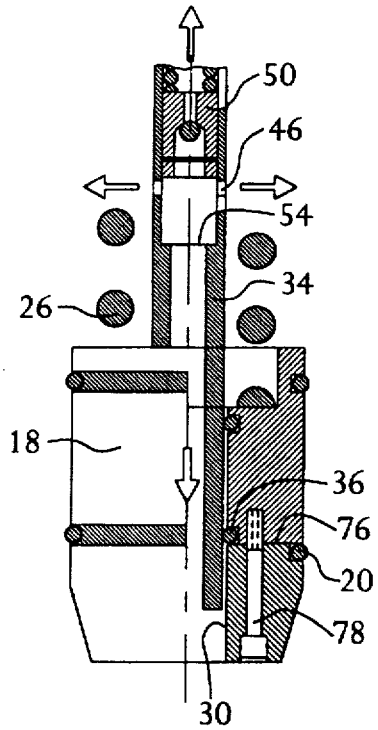

In the following, the invention is described in more detail through references to the attached drawing. The following are shown in the drawing:

FIG. 1 A partially longitudinally sectioned schematic view of a pneumatic beater, FIG. 1*a* An enlarged view of the venting arrangement . . . for the spring space of the beater in accordance with FIG. 1, FIG. 2 A partially sectioned longitudinal view of the piston and the quick-acting ventilation valve of the beater in accordance with FIG. 1, in the state of quick venting, FIG. 3 An additional form of implementation of a pneumatic beater, in which the quick-acting ventilation valve is located in a pipe which is carried along with the piston, FIG. 4 An additional modification of the beater in accordance with FIG. 3, in which the end of the pipe that is moved along with the piston is led out through the end wall of the housing, and FIG. 5 A special configuration of the housing end wall on the spring space side, with built-in check valve.

A pneumatic beater is shown in FIG. 1 in longitudinal section and partly in schematic form. The beater exhibits a housing 2, which is comprised of a cylindrical housing jacket 4, an end wall 6 at one end of the housing jacket, and a flange 8 at the other, open end of the housing jacket 2. The flange 8 is provided with a ring seal 10 on its outside and with screw holes 12 at its circumference. By means of the flange 8, the beater can thus be screwed in a sealed fashion to the object which is to be exposed to the beating impacts. Optionally, a spacer plate 14 which is internally provided with an elastomer insert 16 can, for example, also be provided between the beater and this object. An elastomer insert of such a type damps the impact beats of the piston to a certain extent, and contributes to extending the life of the beater and the impact surface, as well as substantially reducing the noise.

In addition, the beater exhibits a beating piston 18, which is conducted in a sliding fashion in the housing jacket 4 by means of ring seals 20 which are inserted into grooves in the beating piston. The upper (in terms of the drawn representation) end 22 of the beating piston 18 is provided with a recess 24 in which a coil spring 26 is supported at one end, while its other end lies against the top end wall 6 of the housing 2. The space which is bounded by the housing jacket 4, the top face 22 of the stroking piston and the housing end wall 6 is known as the spring space 28, and the top housing end wall 6 is also known as the housing end wall on the spring space side. By way of example, concentric multiple spring arrangements can also be provided in place of the single coil spring 26.

The beating piston 28 is provided with a central axial bore 30 which goes all the way through. On the other side, a pipe 34 which passes through the end wall 6 of the housing is screwed to it, by means of a nut 32, against a retaining ring, the free, lower end of which projects into the central bore 30 of the piston and is likewise conducted within it in a sliding and sealed fashion by means of sealing rings 36 which are sunk into the wall of the piston bore 30. The pipe 34 projects into the lower part of the beater to an extent such that the sealing rings 36 remain effective throughout the piston's entire range of motion. The stroking piston 18 exhibits a lower face 38. A pressurization space 40 for the beating piston is bounded by this face 38, the housing jacket 4, or more specifically, the inside of the flange 8, and an opposing surface (not shown) of the object to which the beater is screwed. The interior space of the pipe 34 forms a connecting channel 42 from a supply connection (not shown in detail) for the compressed air at the top end of the pipe 34 at the arrow 44 into the pressurization space 40. In a region of the pipe 34 which is not covered by the stroking piston at any time within the piston's range of motion, there are provided in the wall of the pipe 34 radial openings 46, as shown in FIG. 1, into the spring space 28 which form a secondary channel of the connecting channel 42.

In the region of these openings 46, an automatic valve arrangement 48 is provided inside the pipe 34. This valve arrangement consists of a control piston 50, which is placed in the upper part of the pipe 34 in such a way that it can slide axially, and against which a spring 52, which is supported in the region of the end wall 6 of the housing, is in place. The range of motion of the control piston 50 is limited in the downward direction by means of a limit stop 54 on the inner wall of the pipe 34. In the resting state, the piston 50 is pressed against this limit stop 54 by the spring 52, and thus closes the openings 46 in the pipe 35 by means of its outer jacket surface. The control piston 50 is provided with a stepped axial through-bore 56 in which is placed a ball check valve 58, the design of which is known. This ball check valve 58 is aligned in such a way that it opens when there is new, incoming compressed air from the connection 44, but closes when there is a positive pressure difference coming from the direction of the pressurization space 40.

The spring space 28 is in essence hermetically sealed, however, an air discharge opening 60 is provided in the housing jacket which allows the reduction of an overpressure on the spring space 28 when the piston is moved back against the coil spring 26. As can be seen in the enlargement in FIG. 1*a*, a check valve 62, which allows the outward flow of overpressure air to the outside but prevents the entry of outside air into the spring space, is placed in the air discharge opening 60 as well.

The manner of functioning of the pneumatic beater described above is briefly explained in the following, in which regard it is to be assumed that the beater illustrated in FIG. 1 is not controlled automatically with respect to its pressurization and frequency, but is instead controlled externally. For that purpose, at the location of the arrow 44 the beater is provided with a compressed air connection in which a frequency controlled 3/2-way valve is located. The beater is intermittently impinged upon by compressed air by means of this valve (not shown), i.e., compressed air is allowed to flow into the beater. The impact takes place with the venting.

The compressed air which is being supplied goes through the valve arrangement 48, which in its resting state closes off the openings 46 in the pipe 34, and when the ball check valve 58 in the control piston 50 is open, the compressed air goes directly into the pressurization space 40 and presses the beating piston 18 upward against the restoring force of the coil spring 26. The beating piston 18 is brought into an equilibrium position which is dependent upon the pressure from the supplied compressed air and the spring.

At the moment at which both the supplied compressed air is shut off and the supply line is vented, ambient pressure prevails above the control piston 50, while the increased pressure on the pressurization space 40 is present at the underside of the control piston. The ball check valve 58 is closed as a result of the differential pressure, and as a result of that, the control piston is pressed upward against the spring 52 until it frees the openings 46. This state is shown in the components which are illustrated in FIG. 2. The black arrows in FIGS. 1 and 2 represent the momentary piston movement and the white arrows represent the air movement.

As a result of the fact that the stroking piston 18, which is moving downward rapidly, creating a low pressure in the spring space 28, the transfer of air from the pressurization space 40 into the spring space 28 takes place even more quickly. As can easily be seen from FIGS. 1 and 2, the transfer air can take what is practically the shortest path between the pressurization space 40 and the spring space 28. The connecting channel 42, in the form of the pipe 34, has an adequate flow cross-section, and the openings 46 in the wall of the pipe 34 can be made suitably large as well. The control piston 50 is not in this flow path, as can be seen from FIG. 2. The fact that the interior of the control piston 50 has a channel with only a small cross section does not affect the effectiveness of the invention, since a small cross section is adequate for the supplying of the compressed air for the inflow of the new compressed air and for the energizing time period, which is relatively long in comparison with the stroke of the piston.

FIG. 3 illustrates a modified implementation form of a pneumatic beater. In this form of implementation, in place of the pipe 34 of the form of implementation according to FIGS. 1 and 2, a pipe, or rather, a pipe segment 64 is provided which is solidly connected with the stroking piston 18, and more specifically, with its upper face (relative to the drawn representation). This pipe segment 64 is recessed a little into the beating piston 18 only for the purpose of fastening it. The channel formed by the pipe continues inside the piston as an axial channel which is formed by the bore 66, the diameter of which advantageously corresponds approximately with the diameter of the pipe 64. A metal expansion bellows 70, the other end of which is attached to the inside of the upper end wall 6 of the housing, is fastened to the upper end of the pipe 64 by means of a transition piece 68. The supply connection 72 for the compressed air discharges into the bellows in the end wall 6. The metal expansion bellows 70 is designed to be pressure-resistant for the pressures that are being used. The spring rate of the metal expansion bellows can be selected in such a way that it can support the energy storage of the pressure spring 26. The valve arrangement 48 in the form of implementation according to FIG. 3 is designed in the same way as the one used in the version according to FIG. 1. Since the pipe segment 64 in the form of implementation according to FIG. 3 is solidly connected to the stroking piston 18, this form of implementation has the advantage that the openings in the wall of the pipe section, which are identified with 46, can be placed directly above the top of the stroking piston 18, so that the shortest flow path between the pressurization space 40 and the spring space 28 can always be maintained, even when the beating piston 18 has moved.

In the form of implementation according to FIG. 4, instead of being connected to the metal expansion bellows in the form of implementation according to FIG. 3, the pipe segment 64 is instead connected to an additional pipeline 74, which is directed through an opening in the end wall 6 of the housing in a movable fashion. This pipeline 74 can be rigid, but it can also exhibit a certain flexibility. In this form of implementation, the movement of the beating piston 18 is transferred via the pipeline 74 into a region outside of the beater housing. If this pipeline outside the housing also exhibits an elbow for the connecting of a compressed air connection, as is illustrated in FIG. 4, there is a possibility that a person could get caught between the pipeline 74 and the end wall 6 of the housing during the execution of the impact. The form of implementation according to FIG. 4 is thus not especially preferable.

In FIG. 2, it can be seen in the cutaway region of the beating piston 18 that the piston is implemented in such a way that it is divided along a horizontal plane 76 in its lower segment in the region of the sealing rings 20 and 36. The piston parts are screwed together by means of a screw connection 78. Sealing rings made of PTFE, which are preferred when oil-free compressed air and/or high temperatures are being used, are very difficult to install, particularly in internal grooves in bores, for which reason the divided implementation of the piston in this case aids assembly. In connection with that, the grooves for the inner and outer seals are advantageously placed in such a way that they fall in the region of the similar dividing planes. The one-piece piston according to FIG. 1 can be used with oiled compressed air.

Finally, FIG. 5 shows a modified cylinder head into which an elastomer plate 78 is embedded. Here, the check valve for the venting of the spring space is housed inside the elastomer plate as check valve 80. The venting itself does not take place through the housing end wall 6 directly at the site of the check valve, but instead goes via a ring groove 82 to a venting opening 84 at another location on the housing end wall 6. Because of this, the check valve 80, which is designed as a ball valve, can be easily designed and installed. The valve ball can be inserted loose into a corresponding recess in the elastomer plate 78.

I claim:

1. Pneumatic beater comprising a housing with a housing jacket and at least one end wall;

a stroking piston axially slidable in the housing jacket;

a spring space defined by a first piston face, the housing jacket and the housing end wall;

a pressure spring inside the spring space, between the first face of the piston and the housing;

a pressurization space defined by a second face of the piston, the housing jacket and an opposing surface solidly affixed to the housing;

a supply connection connected to the housing for supplying a pressure medium;

a connecting channel for the pressure medium which runs from the supply connection to the pressurization space; and an automatic valve located in the connecting channel and including a secondary channel communicating with the spring space, the automatic valve selectively blocking the connecting channel from the supply connection, while connecting the pressurization space with the spring space;

wherein the connecting channel includes an axial channel (66) through the stroking piston (18) and a duct through the spring space (28); and wherein the secondary channel is formed by radial openings (46) in the duct.

2. Pneumatic beater in accordance with claim 1, wherein the duct (34) has one end solidly connected to the housing end wall (6) on the spring space side, and another end which slides sealingly in the axial channel (30) in the stroking piston (18).

3. Pneumatic beater in accordance with claim 1, wherein the duct (64) is solidly connected to the stroking piston (18).

4. Pneumatic beater in accordance with claim 3, wherein the duct (64) is connected to one end of a pressure-resistant expansion bellows (70), the pressure-resistant expansion bellows having another end connected with the housing end wall (6) on the spring space side.

5. Pneumatic beater in accordance with claim 3, wherein the duct (64, 74) is directed in a sealing and sliding fashion through the housing end wall (6) on the spring-space side, and, on its end located outside of the housing, is provided with the supply connection for the pressure medium.

6. Pneumatic beater in accordance with at least one of the claims 2 through 5, wherein the openings (46) which form the secondary channel discharge directly into the spring space (28).

7. Pneumatic beater in accordance with claim 6, wherein the automatic valve (48) is located inside the duct.

8. Pneumatic beater in accordance with claim 6, wherein the automatic valve includes a control part (50) slidable sealingly in the duct in the axial direction to selectively open or close the openings (46) of the secondary channel.

9. Pneumatic beater in accordance with claim 8, wherein the control part is held against a limit stop (54) in a position which closes off the secondary channel, by an elastic means (52); and is selectively moved against the elastic means (52) toward the supply connection (44, 72) for the pressure medium, and into a position which uncovers the secondary channel in response to a pressure in the pressurization space (40) being higher than a pressure in the supply connection.

10. Pneumatic beater in accordance with claim 8, wherein the control part (50) contains an axial flow-through channel (56) with a check valve (58) closing the flow-through channel in response to a pressure in the pressurizing space (40) being higher than a pressure in the supply connection.

11. Pneumatic beater in accordance with at least one of the claims 1 through 5 wherein the spring space (28) is closed off from outside the housing, in a pressure-tight fashion, except for a discharge passage (60, 62).

12. Pneumatic beater in accordance with claim 11, wherein the discharge passage includes a check valve (62).

13. Pneumatic beater in accordance with at least one of the claims 1 through 5, wherein the opposing surface is formed by an external object connected to the housing (2) of the pneumatic beater in a pressure-tight fashion.

14. Pneumatic beater in accordance with at least one of the claims 1 through 5, wherein the stroking piston (18) includes two parts connected together by means of a screw connection (78); and wherein the two parts are joined in a region including sealing ring grooves.

* * * * *